US005503485A

United States Patent [19]

Nakazato

[11] Patent Number: 5,503,485

[45] Date of Patent: Apr. 2, 1996

[54] TAPE PRINTING APPARATUS

[75] Inventor: Takashi Nakazato, Tokyo, Japan

[73] Assignee: Max Co., Ltd., Tokyo, Japan

[21] Appl. No.: 235,323

[22] Filed: Apr. 29, 1994

[30] Foreign Application Priority Data

Apr. 30, 1993 [JP] Japan ..... 5-127918

[51] Int. Cl.[6] ..... B41J 15/04

[52] U.S. Cl. ..... 400/613; 400/615.2; 400/648

[58] Field of Search ..... 400/611, 613, 400/615, 615.2, 648, 649, 659, 662; 346/136

[56] References Cited

U.S. PATENT DOCUMENTS 5,009,530 4/1991 Kuzuya et al. ..... 400/615.2
5,184,152 2/1993 French ..... 346/76 PH

FOREIGN PATENT DOCUMENTS 2164112 7/1973 Germany ..... 400/613
57-148676 9/1982 Japan ..... 400/613
63-230372 9/1988 Japan ..... 400/613
5-177828 7/1993 Japan ..... 400/613

*Primary Examiner*—David A. Wiecking
*Attorney, Agent, or Firm*—Cushman Darby & Cushman

[57] ABSTRACT

A tape printing apparatus has a main body, a print device mounted on the main body, and a tape wound body being rotatably supported on the main body. The tape wound body has an annular core member, and a print tape wound on the annular core member. The print tape includes a tape base material including a print surface, and an adhesive layer being exposed to a surface opposite to the print surface of said tape base material. The print device prints data on the print surface of the print tape wound on the tape wound body. The print device contacts an outermost print surface of the print tape. The main body includes a bias device for urging the tape wound body toward the print device, a tape feeder for rotating the tape wound body in contact with an outer circumferential surface of the tape wound body, and a tape separator for separating the print tape by peeling off the print tape in a wound state.

6 Claims, 3 Drawing Sheets

TAPE PRINTING APPARATUS

BACKGROUND OF THE INVENTION

1. Field of Invention

The invention relates to a tape printing apparatus which includes a tape wound body formed by winding a print tape about an annular core member, and prints data directly on a print tape surface of the tape wound body. The print tape has an adhesive layer exposed on a tape base material.

2. Description of Related Art

A demand for tape printing apparatuses designed to print data on a print tape has grown lately. However, print tapes used in conventional tape printing apparatuses have an adhesive layer formed by providing a pressure sensitive adhesive double coated tape or an adhesive coating on a surface opposite a print surface of a tape base material and a separating tape stuck to the back of the adhesive layer. Alternatively, the conventional print tapes have a protective transparent tape stuck to the print surface of the tape base material. Being of such multi-base material and multi-layer structure, most conventional tape wound bodies are expensive, and therefore do not satisfy cost requirements.

It is for this reason that a printing apparatus that can print on an inexpensive print tape has been requested.

SUMMARY OF THE INVENTION

The invention has been made in view of the above circumstances. Accordingly, the invention provides a tape printing apparatus capable of using an inexpensive tape wound body not particularly having a separating tape.

The invention provides a tape printing apparatus having a main body, a print device mounted on the main body, and a tape wound body rotatably supported on the main body. The tape wound body has an annular core member, and a print tape wound on the annular core member. The print tape includes a tape base material which includes a print surface, and an adhesive layer exposed to a surface opposite the print surface of the tape base material. The print device prints data on the print surface of the print tape wound on the tape wound body. The print device contacts an outermost print surface of the print tape. The main body includes a bias device for urging the tape wound body toward the print device, a tape feeder for rotating the tape wound body in contact with an outer circumferential surface of the tape wound body, and a tape separator for separating the print tape by peeling off the print tape in a wound state.

The bias device may be formed either of a bias roller arranged inside the annular core member of the tape wound body, or to bias a support member for rotatably supporting the annular core member of the tape wound body toward the print device with a spring.

According to the thus constructed printing apparatus, printing is effected with the tape wound body rotated by the feeder and with the outermost print surface of the tape wound body biased onto the print device by the bias device through the ink ribbon. The print tape is used by peeling the printed portion off the tape wound body with the tape separator and cut therefrom.

Therefore, according to the invention, an inexpensive print tape having only an adhesive layer on a surface of the tape base material can be used, which contributes to significantly curtailing the print cost.

Moreover, since the tape wound body is biased onto the print device by the bias device when printing, even if the amount of wound print tape decreases, the print surface of the tape wound body can be biased onto the print device at a constant pressure at all times. As a result, there is no likelihood that defective printing attributable to a reduced amount of wound print tape will occur. In addition, the tape feeder abuts against the outermost circumferential surface of the tape wound body, the tape forward amount is maintained constant at all times irrespective of the amount of wound print tape on the tape wound body.

Still further, since the above-mentioned printing apparatus requires no platen, as required in conventional printing apparatus, the manufacturing cost of the printing apparatus can be reduced.

If the bias means is formed by a bias roller disposed inside the annular core member of the tape wound body, a space inside the tape wound body can be utilized effectively. Therefore, the apparatus can have a compact structure. Further, the tape wound body can be attached and detached with ease if the support member for rotatably supporting the annular core member of the tape wound body is formed to be urged toward the print device with a spring.

DETAILED DESCRIPTION OF THE PREFERRED EMBODIMENTS

Figure 1:
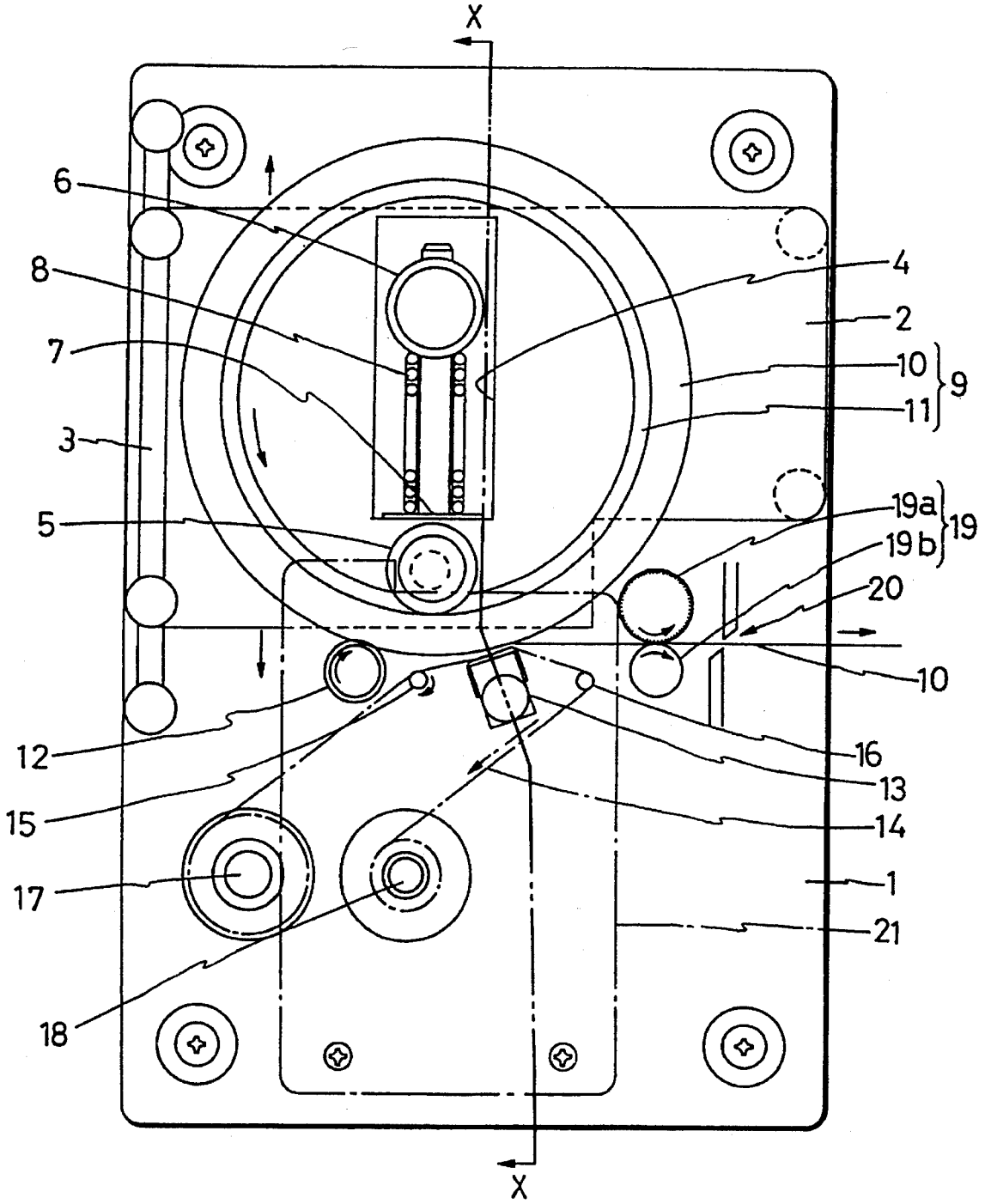
FIG. 1 is a front view showing a main portion of a printing apparatus according to the present invention.
Figure 2:
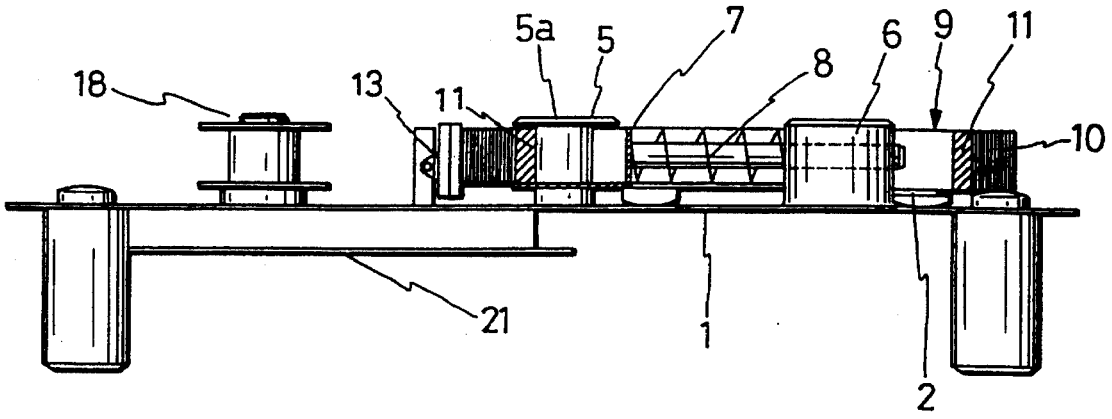
FIG. 2 is a sectional view taken along a line X—X of FIG. 1.

FIGS. 1 and 2 show outlines of a tape printing apparatus according to the present invention. Reference numeral 1 designates a base plate 1 which has the shape of a rectangular box and is disposed on the apparatus body. A slide plate 2 is placed on the base plate 1. The slide plate 2 is arranged to slide along a sliding rail 3 which extends along a long side of the base plate 1.

An opening 4 shaped like a rectangle is located in a central portion of the slide plate 2, and a bias roller 5 is rotatably mounted on an extension of one of the opening end sides of the opening 4. The bias roller 5 which is reel-like has a flange **5*a* on top thereof (as seen in FIG. 2). The base plate 1 has a spring receiving cylinder 6 fixed at a position facing the opening 4 of the slide plate 2. A compression spring 8 is interposed between the spring receiving cylinder 6 and a spring receiving strip 7 formed on the bias roller 5 end side of the opening 4**.

Figure 3:
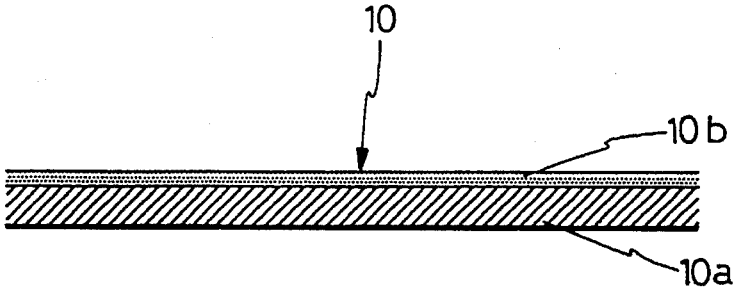
FIG. 3 is a sectional view of a print tape.

A tape wound body 9 is set on the surface of the slide plate 2. The tape wound body 9 is formed by winding a print tape 10 on an annular core member 11. As shown in FIG. 3, the print tape 10 has an adhesive layer **10*b* exposed to a surface opposite a print surface of a transparent or opaque tape base material 10*a*. The tape wound body 9 is arranged outside the bias roller 5 and is set so that the bias roller 5 abuts against the inner circumferential surface of the annular core member 11**.

The base plate 1 has a forward roller 12 and a print head 13. The points of contact between the forward roller 12 and the tape wound body 9, the print head 13 and the tape wound body 9, and the bias roller and the tape wound body 9 which form an isosceles triangle with the point of contact between bias roller 5 and the tape wound body as an apex. The forward roller 12 and the bias roller 5 together form a tape feeder, and is designed to rotate the tape wound body 9 by the rotation thereof. The print head 13 is a print device that thermally transfers characters and the like through an ink ribbon 14.

Therefore, as a result of the above-mentioned construction, the bias roller 5 can move closer to or away from the forward roller 12 and the print head 13 as the slide plate 2 slides. Since the slide plate 2 is usually urged by the compression spring 8 in such a direction that the bias roller 5 moves closer to the forward roller 12 and the print head 13, the bias roller 5 causes the outer circumferential surface of the tape wound body 9 to be biased onto the forward roller 12 and the print head 13 by biasing the inner circumferential surface of the tape wound body 9 on the slide plate 2. The tape wound body 9 maintains a correct position thereof with the flange 5*a* of the bias roller 5. Since the tape wound body 9 is nipped between the forward roller 12 and the bias roller 5, the tape wound body 9 is rotated along with the rotation of the forward roller 12. However, the tape wound body 9 is supported at three points by the bias roller 5, the forward roller 12, and the print head 13. Therefore, the tape wound body 9 rotates stably about the same center at all times. It goes without saying that another support member may be added for stable rotation thereof.

Further, guide rollers 15, 16 for the ink ribbon 14 are provided on both sides of the print head 13 and are carried on the base plate 1. Shafts 17, 18 for mounting a supply reel and a rewind reel of the ink ribbon 14 are also on the base plate 1. The ink ribbon 14 which is mounted on both shafts is passed along the guide rollers 15, 16 through the print head 13.

Then, a tape separator 19 for the print tape 10 is arranged on the print tape discharge side of the base plate 1. The tape separator 19 includes rollers 19*a* and 19*b* which confront each other with the print tape 10 nipped therebetween, and is designed to separate the print tape 10 by peeling off the tape that is in the wound state. Therefore, the print tape 10 is not required to be rewound. However, the tape separator may be designed to serve also as a second feeder to a collection reel. It is desirable that the roller 19*a* of the tape separator 19 be arranged to abut against the back surface (the adhesive surface) of the print tape 10 and that knurls be made on the outer circumferential surface thereof to facilitate the separation of the print tape 10.

A cutting mechanism 20 implemented by a cutter is arranged on the print tape discharge side of the tape separator 19.

On the back side of the base plate 1 is a fixed plate 21, which has an electric motor and reduction gears of a drive mechanism (not shown) for the forward roller 12 and the ink ribbon 14, and a controller of a drive mechanism (not shown) and the like of the print head 13, the tape feeder and the ink ribbon 14.

How the thus constructed printing apparatus is used will be described. First, the ink ribbon 14 is set to fit with the print head 13 by passing the ink ribbon along the guide rollers 15, 16. The tape wound body 9 is set outside the bias roller 5 on the slide plate 2 with the slide plate 2 being caused to slide resisting the compression spring 8 so that the bias roller 5 moves away from the forward roller 12 and the print head 13. When the slide plate 2 is slid thereafter by the force exerted by the compression spring 8, the slide plate 2 stops at a position at which the outer circumferential surface of the tape wound body 9 abuts against the forward roller 12 and the print head 13. At this instance, the bias roller 5 biases the tape wound body 9 onto the forward roller 12 and the print head 13 from inside. The start end of the print tape 10 is nipped between the rollers 19*a*, 19*b* of the tape separator 19.

When the printing apparatus is activated under this condition, the controller (not shown) causes the print head 13 to print characters and the like on the outermost tape surface of the tape wound body 9 through the ink ribbon 14. At the same time, the forward roller 12 that abuts against the outermost circumference of the tape wound body 9 is rotated to forward the print tape 10 to the discharge side by rotating the tape wound body 9 with the bias roller 5. As a result, printing is effected sequentially at a print tape forward speed. The start end of the printed tape 10 is peeled from the tape wound body 9 and is discharged to the discharge side by the tape separator 19. Upon the end of printing, the print tape 10 can be cut by the cutting mechanism 20. Since the discharged print tape 10 has the adhesive layer 10*b* thereof exposed, the discharged print tape 10 can be affixed to an object.

As described above, the tape printing apparatus can use the inexpensive print tape 10 having an adhesive layer only on a single surface of a tape base material, thereby allowing the print cost to be curtailed significantly.

Moreover, as printing progresses, the amount of the print tape 10 wound on the tape wound body 9 decreases. However, the decrease of the size of the tape wound body 9 is accommodated by the bias roller 5 moving closer to the forward roller 12 and the print head 13 by the compression spring 8. Therefore, the bias force with respect to the print head 13 stays constant at all times. Hence, the print quality of the print tape 10 is not affected by the amount of wound print tape 10. In addition, since the forward roller 12 abuts against the outermost circumferential surface of the tape wound body 9, the tape forward amount remains constant at all times independently of the amount of wound print tape 10 on the tape wound body 9, and a stable print quality can be ensured as well.

Further, since the printing apparatus does not employ a platen that is required in the conventional printing apparatus, the manufacturing cost can be reduced.

While the example in which the tape wound body 9 is set on the slide plate 2 and the bias roller 5 is arranged on the inner side of the tape wound body 9 has been described in the above embodiment, the application of the invention is not limited thereto. For example, it may be designed so that the tape wound body 9 is set directly on the base plate 1 and the bias roller 5 is caused to mover over the base plate 1 in the basing direction or the bias roller 5 is biased from outside the tape wound body 9.

Figure 4:
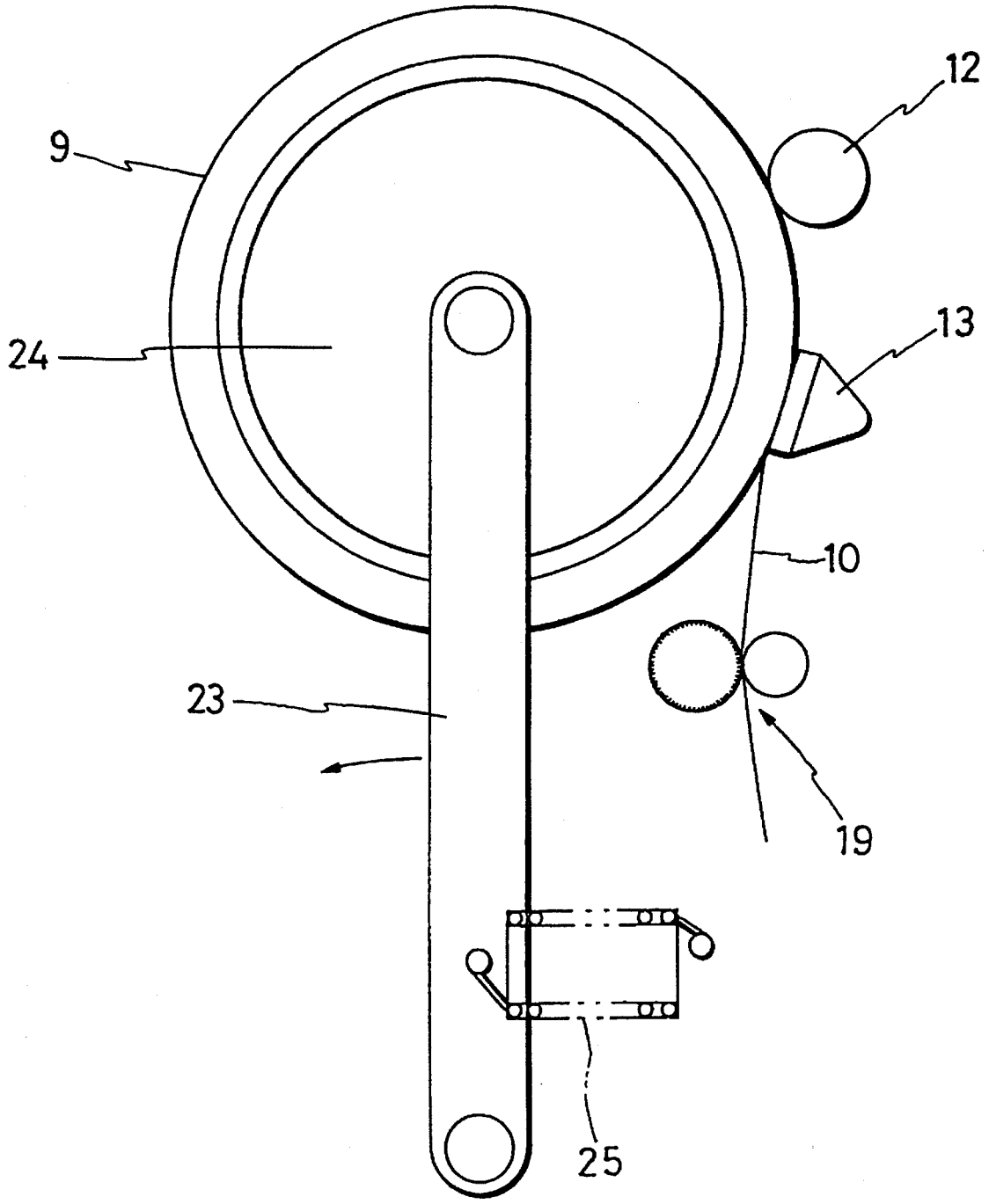
FIG. 4 is a diagram illustrative of a main portion of another exemplary bias device.

In addition, as shown in FIG. 4, the following design may be applicable. A bias arm 23 is arranged on the base plate 1 to oscillate to the right and to the left. A rotatable mounting disc 24 is arranged on a distal end of the bias arm 23. Furthermore, the bias arm 23 is biased toward the forward roller 12 and the print head 13 by a spring 25. In this case, the tape wound body 9 is mounted on the mounting disk 24 after the bias arm 23 has been oscillated in the direction of the arrow in FIG. 4, against the force exerted by the spring 25, and then has been picked up. As a result, the tape wound body 9 is biased onto the forward roller 12 and the print head 13 by the bias arm 23. This contributes to facilitating the attaching and detaching of the tape wound body 9 to a great degree.

What is claimed is:

1. A tape printing apparatus comprising:

a tape wound body comprising:

an annular core member, and a print tape wound on said annular core member, said print tape comprising:

a tape base material having a print surface and an adhesive layer exposed to a surface opposite said print surface of said base material;

print means for printing data on said print surface of said print tape wound on said tape wound body, said print means contacting an outermost print surface of said print tape; and a main body rotatably supporting said tape wound body and mounting said print means thereon, said main body comprising:

bias means, positioned inside of said tape wound body, for urging said tape wound body toward said print means, said bias means comprising a bias roller arranged inside said annular core member of said tape wound body, tape forward means for rotating said tape wound body in contact with an outer circumferential surface of said tape wound body, and tape separating means for separating said print tape by peeling off said print tape in a wound state.

2. A tape printing apparatus according to claim 1, wherein said bias means further comprises a spring urging said bias roller toward said tape wound body.

3. A tape printing apparatus according to claim 1, wherein said bias means, said tape forward means, and said print means support said tape wound body.

4. A tape printing apparatus comprising:

a tape wound body comprising:

an annular core member, and a print tape wound on said annular core member, said print tape comprising:

a tape base material having a print surface and an adhesive layer exposed to a surface opposite said print surface of said base material;

print means for printing data on said print surface of said print tape wound on said tape wound body, said print means contacting an outermost print surface of said print tape; and a main body rotatably supporting said tape wound body and mounting said print means thereon, said main body comprising:

bias means, positioned inside of said tape wound body, for urging said tape wound body toward said print means, tape forward means for rotating said tape wound body in contact with an outer circumferential surface of said tape wound body, and tape separating means for separating said print tape by peeling off said print tape in a wound state.

5. A tape printing apparatus according to claim 1, wherein said bias means comprises:

a support member for rotatably supporting said annular core member of said tape wound body, and a spring urging said support member toward said print means.

6. A tape printing apparatus according to claim 4, wherein said tape wound body has a cylindrical shape, and the center of said tape wound body is slidable toward said tape forward means against said main body.

* * * * *